US010867493B2

(12) United States Patent
Pattyn et al.

(10) Patent No.: US 10,867,493 B2
(45) Date of Patent: Dec. 15, 2020

(54) THREAT DETECTION INFORMATION DISTRIBUTION SYSTEM AND METHOD

(71) Applicant: VSK ELECTRONICS NV, Harelbeke (BE)

(72) Inventors: Kurt Pattyn, Harelbeke (BE); Jorg Tilkin, Harelbeke (BE)

(73) Assignee: VSK Electronics NV, Harelbeke (BE)

( * ) Notice: Subject to any disclaimer, the term of this patent is extended or adjusted under 35 U.S.C. 154(b) by 0 days.

(21) Appl. No.: 16/674,899

(22) Filed: Nov. 5, 2019

(65) Prior Publication Data

US 2020/0066123 A1 Feb. 27, 2020

Related U.S. Application Data

(62) Division of application No. 15/123,474, filed as application No. PCT/EP2015/054197 on Feb. 27, 2015, now Pat. No. 10,467,871.

(30) Foreign Application Priority Data

Mar. 3, 2014 (AU) ..... 2014900702

(51) Int. Cl.
*G08B 13/196* (2006.01)
*G08B 25/01* (2006.01)

(52) U.S. Cl.
CPC ..... *G08B 13/19645* (2013.01); *G08B 25/014* (2013.01)

(58) Field of Classification Search
CPC ..... G08B 13/19645; G08B 25/014
(Continued)

(56) References Cited

U.S. PATENT DOCUMENTS 7,221,928 B2 * 5/2007 Laird ..... A61B 5/04 455/404.1
2013/0111545 A1 * 5/2013 Sharma ..... H04L 63/10 726/1
2015/0111523 A1 * 4/2015 South ..... G08B 25/016 455/404.2

FOREIGN PATENT DOCUMENTS

WO 2015132160 9/2015

OTHER PUBLICATIONS

"International Application No. PCT/EP2015/054197, International Search Report and Written Opinion dated May 19, 2015", (May 19, 2015), 14 pgs.

(Continued)

*Primary Examiner* — Kerri L McNally
(74) *Attorney, Agent, or Firm* — Brooks, Cameron & Huebsch, PLLC

(57) ABSTRACT

A method of distributing data relating to a threat-detection system is provided. The method includes, at a threat-detection information management system, receiving an initialisation request from a central monitoring system, the initialisation request including a client identifier and client data location information relevant to a client site monitored by the central monitoring system. In response to receiving the initialisation request, a respond site code is generated and stored with the client identifier and client data location information as a respond site record, after which it is transmitted to the central monitoring system. An operator of the central monitoring system provides this code to a responder system. A verification request is then received from a responder device, the verification request including a respond site code. The information management system verifies the respond site code corresponds to a respond site code in its data storage and provided that the respond site code exists, transmits the client data location information (Continued)

associated with the respond site code to the responder device.

20 Claims, 8 Drawing Sheets

(58) Field of Classification Search
USPC ..... 340/539.18
See application file for complete search history.

(56) References Cited

OTHER PUBLICATIONS

Cai, Yu, et al., "Secure Group communication in Body Area Networks", Information and Automation, 2008. ICIA 2008. International Conference on; IEEE, Jun. 20, 2008, pp. 555-559, (Jun. 20, 2008), 555-559.

* cited by examiner

THREAT DETECTION INFORMATION DISTRIBUTION SYSTEM AND METHOD

PRIORITY INFORMATION

This application is a Divisional of U.S. application Ser. No. 15/123,474, filed Sep. 2, 2016, which is a National Stage entry of PCT/EP2015/054197, filed Feb. 27, 2015, which claims the benefit of Australian Patent Application No. 2014900702, filed Mar. 3, 2014, the contents of which are incorporated herein by reference.

FIELD OF THE INVENTION

The present invention relates to a threat-detection information distribution system and associated method.

BACKGROUND OF THE INVENTION

In existing threat-detection systems, a central monitoring system is typically communicatively coupled to various client threat-detection systems. Each of the client threat-detection systems is configured to monitor a client site for certain predetermined threat events and to send an alert to, or raise an alarm with, a central monitoring system on the detection of a threat event. For example, and depending on the particular client threat-detection system, if there is a detection of an intrusion, a detection of smoke, or any other relevant detection by the client threat-detection system, the central monitoring system is notified by sending a threat detection alert.

Once a threat detection alert is received by the central monitoring system, an alarm (e.g., an audible or visual alarm) may be activated at a work-station of the central monitoring system in order to draw the attention of the operator. In some existing systems, the operator verifies the threat event by viewing live and/or recorded video streams and/or event snapshots from the particular client sites. On verifying the existence of a threat event, the operator will, if appropriate and according to protocol, first attempt to deter or obviate the threat. For example, by using on-site audio capabilities, the operator may try to scare off any intruder. In case of the detection of smoke, the operator may call a key-holder of the client site, in order to request a preliminary visual inspection by the key-holder.

However, if the threat event persists and if the protocol requires, the operator is to notify a third party dispatching service for intervention. For example, depending on the threat event identified, the operator may contact the police, a security company or the fire brigade. Typically, the operator will phone an emergency contact number of the third party dispatching service and provide the client site address to the service in order for a first responder to be sent out by the dispatching service to the site.

Unfortunately, the first responder will only learn more about the threat event once the responder arrives on site. This results in valuable time being wasted while the responder is travelling to the client site and the responder not being properly prepared.

From the above it is evident that inadequacies are associated with the existing threat-detection and threat-detection monitoring systems.

It is therefore an object of the present invention to provide a threat detection information distribution system that addresses at least some of the aforementioned disadvantages. Alternatively, or in addition, it would be desirable to provide the public with a useful choice.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

In accordance with a first aspect of the present invention, there is provided a method of distributing data relating to a threat-detection system, the method including:

- receiving an initialisation request from a central monitoring system, the initialisation request including a client identifier and client data location information relevant to a client site monitored by the central monitoring system;
- in response to receiving the initialisation request, generating a respond site code and storing the respond site code with the client identifier and client data location information as a respond site record in a data storage;
- transmitting the respond site code to the central monitoring system;
- receiving a verification request from a responder device, the verification request including a respond site code;
- verifying that the respond site code corresponds to a respond site code in the data storage; and
- provided that the respond site code exists, transmitting the client data location information associated with the respond site code to the responder device.

The client data location information may specify one or more sources of client data relevant to a particular threat that has been detected at a client site by the threat-detection system.

The respond site record may have an associated status, with the method further including the step of:

- communicating the status of the respond site record to the responder device in order to allow or disallow the responder device access to client data at one or more sources of client data location information.

The associated status may be an active status allowing access to the client data, a time-based active status that allows temporary access to the client data until the expiration of a predetermined time period, or an inactive status which disallows access to the client data.

The method may further include receiving the respond site record status with or as part of the initialisation request from the central station.

Typically, communicating the status of the respond site record may include transmitting the status of the client record together with the client data location information to the responder device.

The method may extend to receiving an updated respond site record status from the central monitoring system, wherein the updated status may be an inactive status or an updated time-based active status which extends the predetermined time period.

Additionally, the method may include receiving updated client data location information, wherein the client data location information identifies an updated one or more sources of client data relevant to the threat at the client site or information on a detector device associated with the client data.

The method may also include receiving an operator message relevant to the monitored client site, the operator message to be further transmitted to the responder device.

According to a second aspect there is provided a method of obtaining client data at a responder device, the client data relating to a client site monitored by a threat-detection system, the method including:

at the responder device, receiving a respond site code associated with a respond site record stored at a threat-detection information management system;

transmitting the respond site code to the threat-detection information management system in order for the system to verify the existence of the respond site record on a data storage at the information management system;

receiving a response from the information management system providing client data location information, which location information specifies one or more sources of client data relevant to a particular threat that has been detected at a client site associated with the respond site record;

in response to receiving the client data location information, establishing a connection with the one or more sources in order for the responder device to receive client data relevant to the particular threat; and displaying at least some of the received client data on a display of the responder device.

The method may further include generating and launching a graphical user interface prompting a user to enter the respond site code; wherein the respond site code is received as a user input through the graphical user interface displayed on the responder device.

Typically, the response from the information management system may further include a status associated with the respond site record which status, when active, allows the responder device access to the one or more sources of the client data, when temporarily active, allows the responder device access until the expiration of a predetermined time period, and when inactive, disallows access to the one or more sources of the client data.

The method may further extend to receiving an updated respond site record status at the responder device, in response to which the status is changed to inactive, thereby disallowing the responder device to obtain client data; or wherein the predetermined period of the temporarily active status is extended for a further period.

The step of receiving the updated client record status may be preceded by polling the information management system.

The step of establishing a connection with the one or more sources may include parsing the client data location information in order to obtain one or more network location addresses, associated connection port data and login credentials; establishing one or more communication channels based on the parsed information; and receiving client data relevant to a particular threat that has been detected by the threat-detection system.

The received client data may include one or more of the following:

a name of the client site;

one or more maps of at least portions of the client site;

video content from one or more surveillance cameras at the client site;

contact details of a key-holder to the client site;

fire panel information relating to the client site; and an address of the client site.

The method may extend to receiving an operator message relevant to the monitored client site.

According to a third aspect of the invention there is provided a method of distributing data within a threat-detection distribution system including:

receiving a threat detection alert from a client site;

receiving one or more inputs from an operator through a user interface, the inputs to identify client data relevant to the threat detection alert at the client site, in response to the inputs, creating a client event record including the identified client data;

in response to creating the client event record, generating and transmitting an initialisation request to a threat-detection information management system, the initialisation request including a client identifier associated with the client event record and location information of the identified client data; and receiving a respond site code from the information management system, the respond site code to be provided to a remote responder thereby to allow a remote responder device to request client data associated with the site record code.

The identified client data may include one or more of the following:

a name of the client site;

one or more maps of at least portions of the client site;

contact details of a key-holder to the client site;

video content from one or more surveillance cameras at the client site fire panel information relating to the client site; and an address of the client site.

Typically, the location information of the identified client data directs to the threat-detection information management system, while the method may further include transmitting sources of the identified client data to the information management system.

The respond site code may be automatically transmitted to a remote responder system.

The method may further include determining a status of the client event record and transmitting the status to the information management system, wherein the status to allows or disallows the remote responder device access to client data at the one or more sources of client data location information.

The status may be determined based on a user input via the user interface. Typically, the status may be dependent on a predetermined time-period.

According to another aspect of the invention there is provided a threat-detection information management system including:

at least one processing unit and at least one memory for storing instructions for execution by the at least one processing unit, the instructions executed to:

receive an initialisation request from a central monitoring system, the initialisation request including a client identifier and client data location information relevant to a client site monitored by the central monitoring system;

in response to the receipt of the initialisation request, generate a respond site code and store the respond site code with the client identifier and client data location information as a respond site record in a data storage;

transmit the respond site code to the central monitoring system;

receive a verification request from a responder device, the verification request including a respond site code;

verify that the respond site code corresponds to a respond site code in the data storage; and provided that the respond site code exists, transmit the client data location information associated with the respond site code to the responder device.

The threat-detection information management system may be further adapted to perform method steps defined above.

According to yet another aspect of the invention there is provided computer program product for execution on a portable communication device comprising a user input and display, the computer program product comprising a non-transitory computer readable medium having computer readable and executable code for instructing one or more processors to perform a method, the method comprising:

receive, at the communication device a respond site code associated with a respond site record stored at a threat-detection information management system;

transmit the respond site code to the threat-detection information management system in order for the system to verify the existence of the respond site record on a data storage at the information management system;

receive a response from the information management system providing client data location information, which location information specifies one or more sources of client data relevant to a particular threat that has been detected at a client site associated with the respond site record;

in response to the receipt of the client data location information, establish a connection with the one or more sources in order for the communication device to receive client data relevant to the particular threat; and display at least some of the received client data on a display of the communication device.

The computer program product for execution on a portable communication device may be further adapted to perform method steps defined above.

According to a final aspect of the invention there is provided a central monitoring system including:

a user interface in order to receive inputs from a user of the system;

at least one processing unit and at least one memory for storing instructions for execution by the at least one processing unit, the instructions executed to:

receive a threat detection alert from a client site;

receive one or more inputs from an operator through the user interface, the inputs to identify client data relevant to the particular detected threat at the client site;

in response to the inputs, create a client event record including the identified client data;

in response to creating the client event record, generate and transmit an initialisation request to a threat-detection information management system, the initialisation request including a identifier associated with the client event record and client data location information; and receive a respond site code from the information management system, the respond site code to allow a remote responder device to request client data associated with the respond site code.

The central monitoring system may be further adapted to perform method steps defined above.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

BRIEF DESCRIPTION OF THE DRAWINGS

Exemplary embodiments of the present invention will now be described by way of non-limiting example only, with reference to the accompanying drawings, in which.

DETAILED DESCRIPTION OF THE EMBODIMENTS

Figure 1:
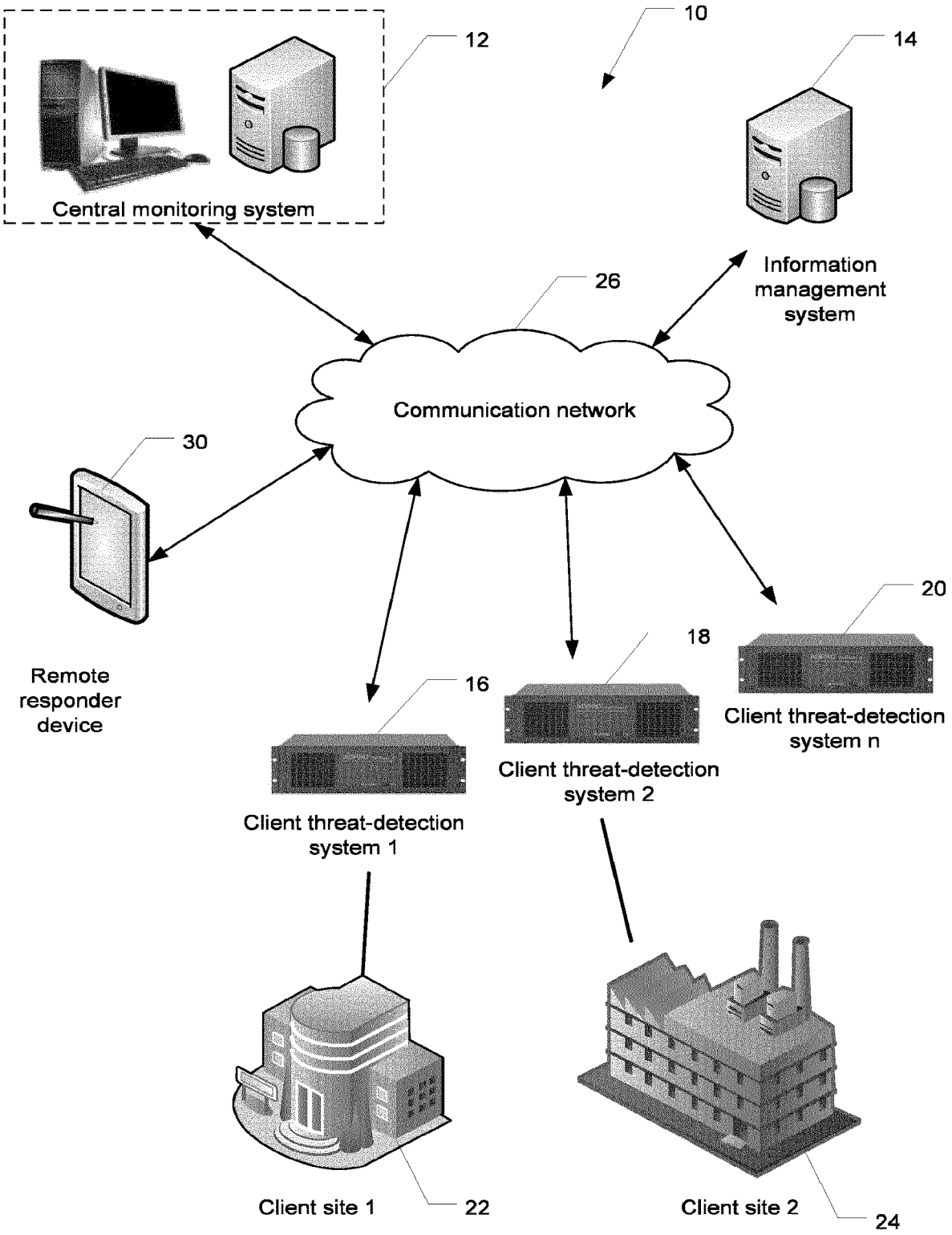
FIG. 1 is a network diagram of a threat detection information distribution system in accordance with an example embodiment of the invention, the information distribution system including a central monitoring system, various client threat-detection systems and an information management system in communication with at least one remote responder device.

FIG. 1 shows a high-level network diagram of a threat-detection information distribution system 10. The threat-detection information distribution system 10 allows a third party remote responder device 30 to access information relevant to a threat event that is occurring at a client site.

The threat-detection information distribution system 10 includes a threat-detection central monitoring system 12 and a threat-detection information management system 14 in communication with one or more client threat-detection systems, represented in FIG. 1 by client threat-detection system 1, 16, client threat-detection system 2, 18 and client threat-detection system n, 20. Each of the client threat-detection systems 16, 18, 20 monitors a respective client site, only two of which are shown in FIG. 1, for threat events. The threat-detection systems 16, 18, 20 may be configured to detect an intrusion, smoke, a combination of intrusion or smoke, or any other specified threat. In the example embodiment described with reference to FIG. 1, for reasons of conciseness, only the client threat-detection system 18 is described in detail. It will however be appreciated that similar configurations may exist for other client threat-detection systems.

Client threat-detection system 18 monitors an industrial client site 24. The system 18 includes various detection devices such as surveillance cameras, smoke detectors, motion detectors or the like, each of which monitors a different area or different security aspect of the industrial client site 24 thereby to identify particular threat events. Example of threat events include an intrusion event which is to be identified by one or more of the surveillance cameras or motion detectors, or a fire event, to be identified by smoke detectors.

The client threat-detection system 18 is in communication with the central monitoring system 12 via a communication network 26. The communication network 26 may be any suitable network such as the Internet, a fixed line network, a wireless network, a private network, or a combination of some of these networks. The client detection devices of the client threat-detection system 18 may either communicate directly with the central monitoring system 12 via this network 26, or alternatively, may communicate via a client station (not shown) at the client threat-detection system with the central monitoring system 12. For example, the client station may process or pre-process information received from the various detection devices. Either way, if any of the detection devices detect a threat event, a threat-detection alert is transmitted via the communication network 26 to the central monitoring system 12.

One or more operators man the central monitoring system 12. The central monitoring system 12 comprises a server and data storage in the form of one or more databases that host information on the various client threat-detection systems 16, 18 and 20. The central monitoring system 12 also has one or more operator stations that may be thin-clients, personal computers or the like, which stations are connected to the server and databases thereby to enable the operators to access relevant data. Each operator station includes one or more user interfaces to display and receive information into the central monitoring system 12. In one example embodiment, the user interface may be a display screen with a keyboard and mouse. Alternatively, the user interface could be a tablet or similar device which has a touch screen with which the operator interacts.

The central monitoring system 12 has one or more processing units and memory, for storing instructions for execution by the processing units. The instructions stored enables the central monitoring system 12 to perform various functions, as will be described in more detail below, to process received data, and to manage communications with the threat-detection information management system 14 and the client threat-detection systems 16, 18 and 20.

The one or more databases of the central monitoring system 12 store information on the various client threat-detection system. This information may differ between client systems but will typically include a client name, a client physical address, emergency contact information, site key-holder information and client threat detection protocol information. This information is typically obtained at the time of signing a contract with the respective clients.

Detailed technical information is also stored on the database for each client. The technical information enables the central monitoring system 12 to have access to monitored site information and to perform its duties. The technical information is typically obtained before commissioning of the system and/or may be updated after such commissioning. For example, the technical information may include:

- an IP address for each client site remote video field unit;
- connection port information for each client site remote video field unit;
- login credentials to access the client site information;
- graphical maps with location information of every detection device; and
- fire panel information.

The abovementioned information is very relevant during a threat event, as it could potentially assist with a third party's response. The central monitoring system 12 also stores client specific information that indicates whether a third party remote responder device may obtain the above information directly from the information management system 14, or whether that information may only be obtained from the central monitoring system 12. In a particular case, some of the above information may even be obtained from a third party source. If from a third party source, the central monitoring system 12 is to store additional information on such source.

Finally, the client monitoring system 12 may store information received on an ongoing basis from the client sites via the client threat-detection systems 16, 18, 20. This information may be detection device status information or may be video surveillance content such as live video feeds or stills (images) captured by the detection devices. Such information may be stored at the central monitoring system 12 for back-up or insurance purposes.

An operator of the central monitoring system 12 opens a client event record once a threat event has been identified at the client threat-detection system 18. As will be described in more detail below, the central monitoring system 12 communicates information to the information management system 14 in order for the information management system 14 to generate and store information which allows the third party responder to access information relevant to the client site threat event via the remote responder device 30, carried by the responder.

The central monitoring system 12 communicates with the information management system 14 over a similar communication network as described above, i.e., any suitable network such as the Internet, a fixed line network, a wireless network, a private network, or a combination of some of these networks. In a preferred embodiment, the information management system 14 is a cloud-service accessible through the Internet. It will however be appreciated that any other suitable architecture and communication protocol could be used.

The information management system 14 comprises one or more processing units and at least one memory for storing instructions for execution by the processing units. The information management system 14 further includes data storage in the form of one or more databases that stores information relating to the client site where a threat-detection event has occurred.

The remote responder device 30 is typically a mobile communication device that includes, in one example embodiment, a touch screen which is both used as a display and as a user input device. A threat-detection software application module is downloaded onto the memory of the device and launched. The software application module includes various instructions to perform processes relating to the threat detection system. The software application module may be downloaded through a software application store or through a web-based interface and operates on the mobile device as an application.

The software application is configured to generate and provide the user of the device, i.e., the responder, with a graphical user interface enabling the user to input relevant data and to select information to be displayed. The software application module is further configured to communicate directly with the information management system 14 in order to obtain threat event information related to the client site 24, and also to directly communicate with sources of client site information, e.g., the information management system 14, the central monitoring system 12 and detection devices forming part of the client threat-detection system 18.

In the preferred example embodiment of the invention as shown in FIG. 1, the central monitoring system 12 and the information management system 14 are described as distinct and separate systems/components. However, it will be appreciated by a person skilled in the art, that in other embodiments the two systems could be an integrated system or a partially integrated system comprising a central monitoring sub-system and an information management sub-system that communicates through a communication interface.

Figure 2A:
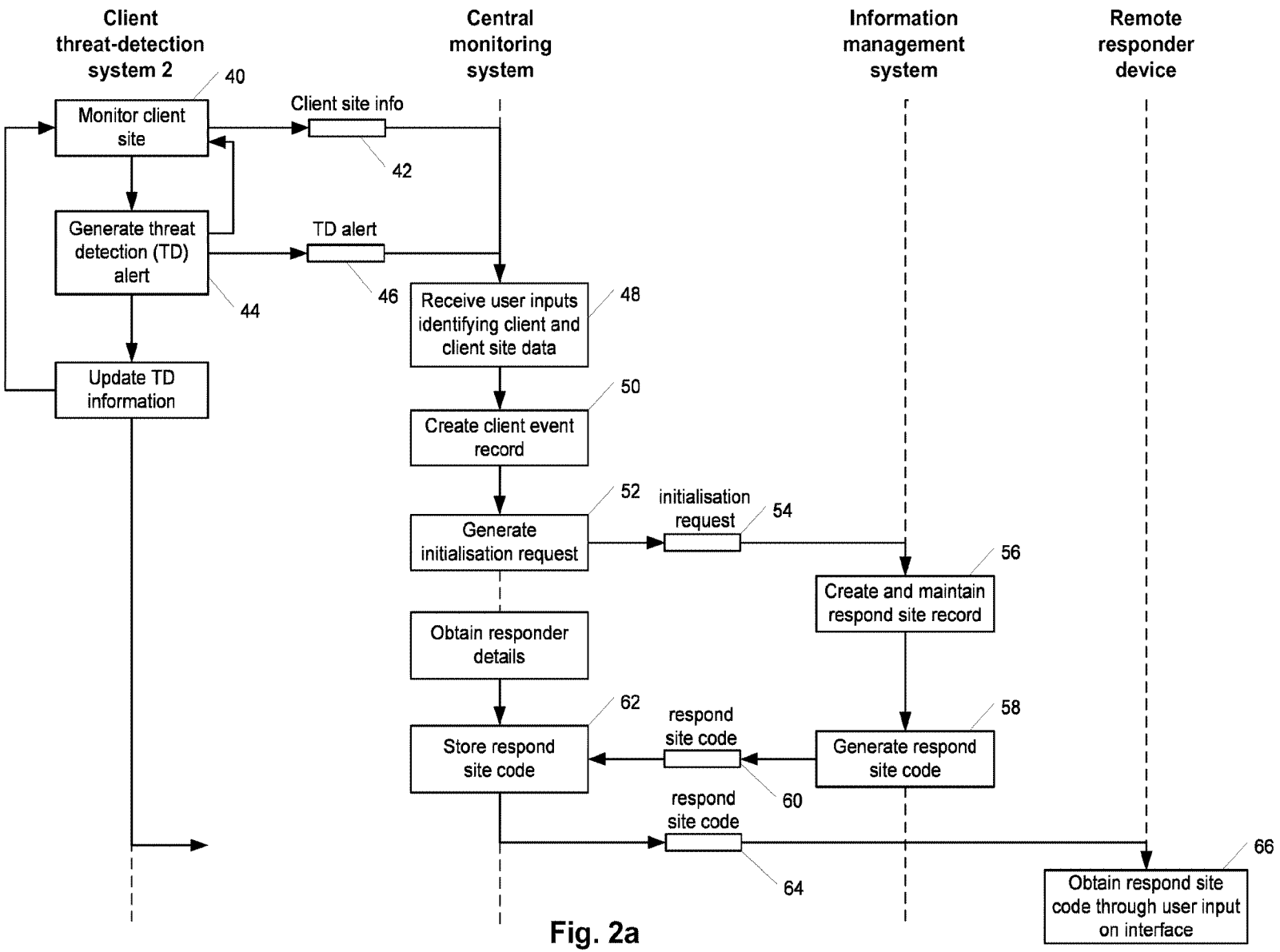
FIGS. 2*a* and 2*b* show a flow diagram setting out various steps between the sub-systems and component of the threat detection information distribution system of FIG. 1, in accordance with an example embodiment of the invention.
Figure 2B:
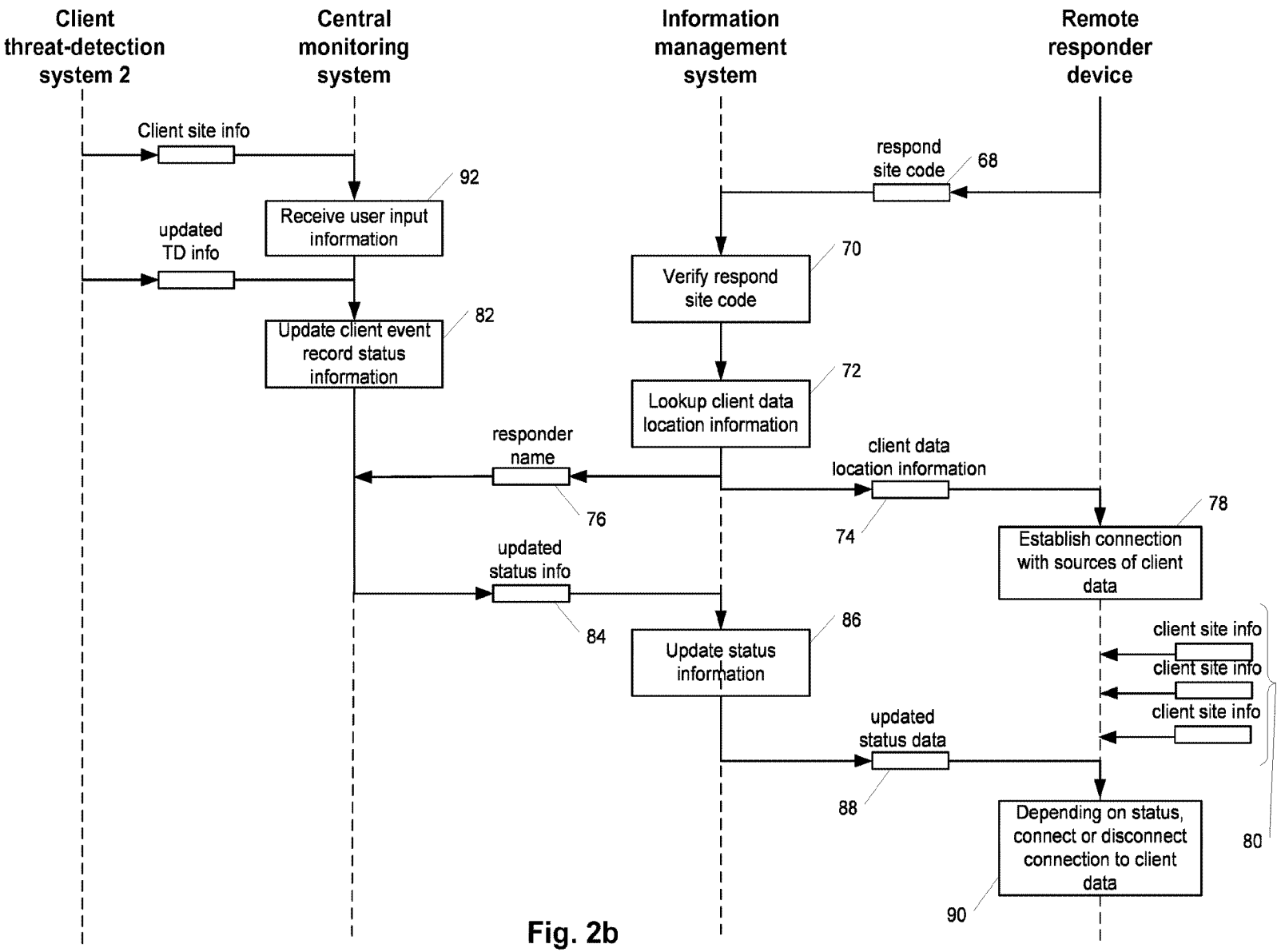

Turning now to FIGS. 2*a* and 2*b*, a flow diagram of a method of distributing information to a remote responder device 30 is shown. As already mentioned, the information that is distributed to the remote responder device 30 provides insight into a threat event occurring at a client site and enables a user of the device better to respond to the threat.

In FIGS. 2*a* and 2*b*, method steps are indicated as they occur between the various systems and device of FIG. 1, i.e. between the client threat-detection system 2 18, the central monitoring system 12, the information management system 14 and the remote responder device 30. As previously mentioned, in the paragraphs below, the operation of the various systems and components is described with reference to a threat event detected at the client site 2, 18. It will be appreciated that threat events could occur at any client site and that the particular configuration of steps will be dependent on the type of event, the client protocol or the like.

As mentioned above and shown by block 40, the client threat-detection system 2, 18 continuously monitors various aspects of the client site 24. Periodic client site information, including detection device status information, video content in the form of live or recorded video feed or the like, is transmitted to the central monitoring system 12 (see block 42) in order to allow operators at the central monitoring system 12 to view and monitor such information. At least some of this received information may be stored or backed-up in the database of the central monitoring system 12.

In this example embodiment, one of the detection devices at the client site 24, a smoke-detector, has detected smoke in its detection range. The client threat-detection system 18 receives this trigger and sounds a smoke alarm at the client site 24. At the same time, a threat detection alert is generated at the client threat-detection system 18 (block 44) and transmitted (block 46) to the central monitoring system 12. The client threat-detection system 2, 18 continues to monitor the client site (block 40).

On receipt of the threat detection alert, the central monitoring system 12 is configured to raise an alarm to draw the operator's attention to the threat event at client site 2, 24. This alarm may take the form of a notification on a graphical user interface displayed on a screen of operator stations, possibly together with an audible sound.

Figure 3:
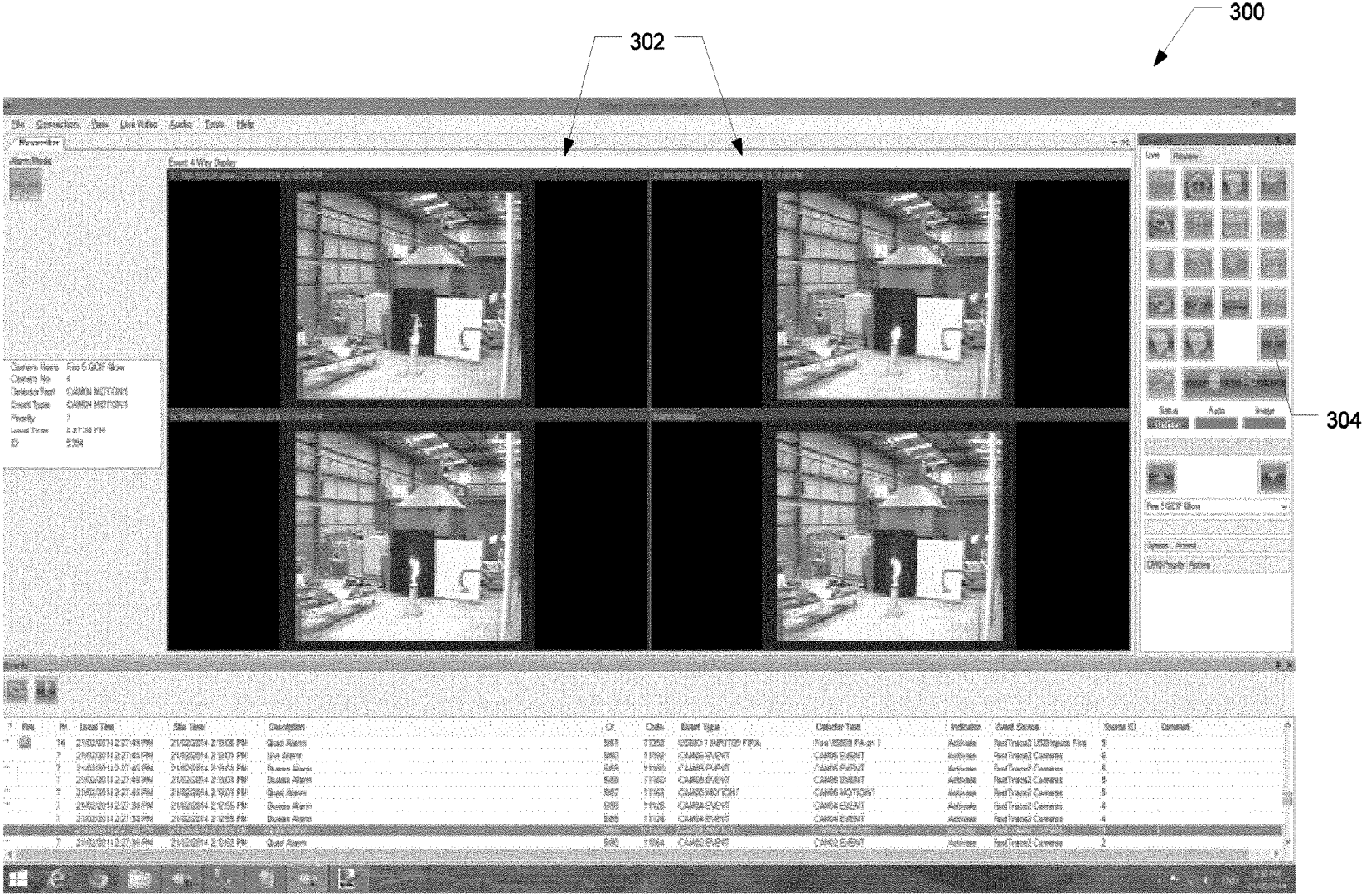
FIG. 3 is a user interface page generated by the central monitoring system of FIG. 1, in accordance with an example embodiment of the invention.

As shown by FIG. 3, a graphical user interface 300 of the central monitoring system 12 allows the operator to view information relating to a threat event, in this case video content in the form of video stills 302 which is received from a video feed of a surveillance camera in the vicinity of the triggered smoke detector at client site 24. From this visual feedback, the operator verifies that the threat event is real and dangerous. In order to mitigate the threat event, the operator may, as a first step, contact a site key-holder. As mentioned above, this contact information is typically stored on the database of the central monitoring system 12. However, if the threat event is too serious and cannot be managed, the operator will contact a third party dispatching service, in this case the fire brigade.

Figure 4:
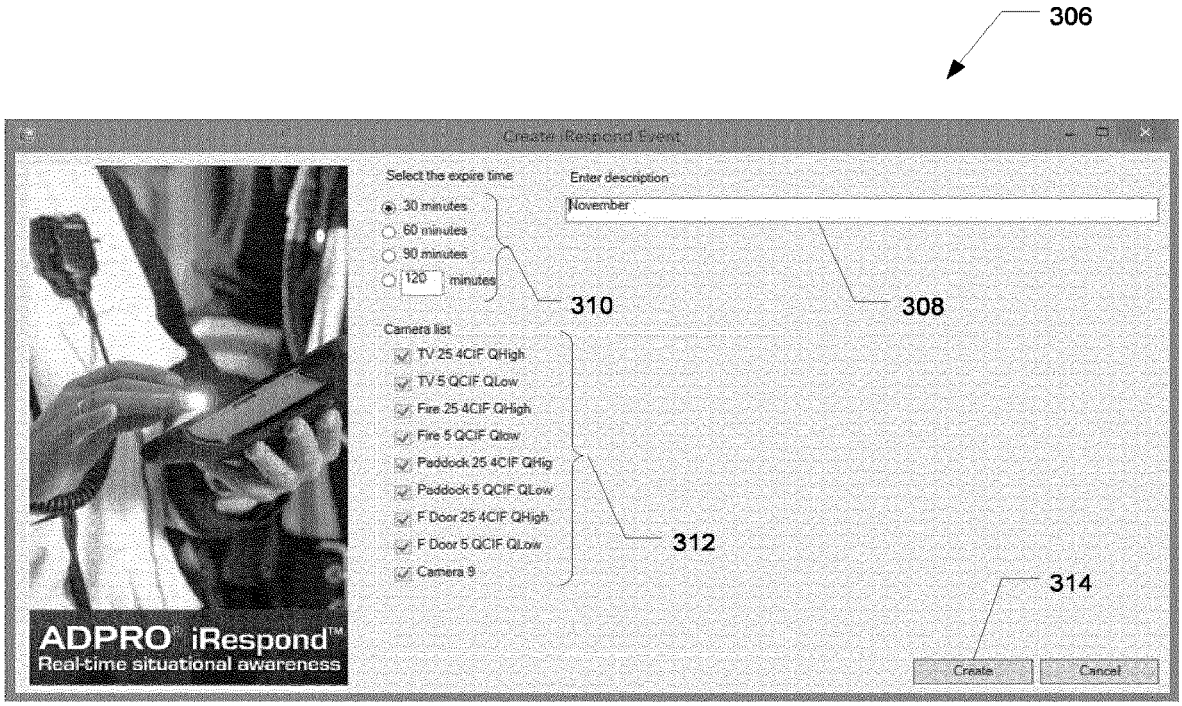
FIG. 4 shows a secondary user interface window generated by the central monitoring system of FIG. 1, which window indicates selection of client site information, in accordance with an example embodiment of the invention.

The present invention allows an operator, prior or after making contact with the fire brigade, to take steps that will ultimately make more detailed information on the threat event at the client site available and accessible to responders from the third party dispatching service. This process is started by the operator in entering various user inputs to identify the relevant client and client site information (block 48) where the threat event is occurring. The user inputs are entered through the graphical user interface of the central monitoring system 12, as will now be described with reference to FIGS. 3 and 4.

The graphical user interface 300 of FIG. 3 includes a soft input button 304, the selection of which launches the creation of a client event record. The relevant client site related to the threat event is automatically selected by the central monitoring system 12, as the operator would have already been viewing information of the threat event at the client site 24. The central monitoring system 12 is configured to generate a second interface window 306 (see FIG. 4) of a graphical user interface. This interface 306 prompts the operator to name the threat event at client site 24 by filling in a name field 308. The interface window 306 further provides the operator with an option to select a predetermined period 310 during which a responder device 30 is to have access to client site data. From information stored in the client monitoring system's database, a list of all security cameras 312 is provided in the interface window 306, with the operator having the option to select relevant video content to be accessible to the remote responder device 30. Once the selections have been made, the operator selects the 'Create' soft button 314, in response to which a client event record is created (see block 50 of FIG. 2*a*). The client event record thus includes a client identifier, which may be a client identification code, the client name or the like, and identified client data, typically relevant information on the selected client site detection devices.

With reference again to FIG. 2*a*, the central monitoring system 12 is configured to generate an initialisation request after the client event record is created (block 52). The initialisation request is transmitted 54 to the information management system 14 and is to include all relevant information in order for the remote responder device 30 to know where to obtain client data relating to the threat event, i.e. the location of client data. Typically, the client data location information is to be stored at the information management system 14. However, in certain instances clients may be unwilling for sensitive information to be transmitted over the communication network 26. It is for this reason that provision is made for location information of client data to be stored elsewhere.

In the example embodiment, the client data that is to be available to the third party responder is the video content from the surveillance camera. Additional client data may also be made available to third party responders. The particular client also allows information on the video content to be stored at the information management system 14, while other client data is to be stored at the central monitoring system 12. Accordingly, the initialisation request includes a client identifier and information to identify both the central monitoring system 12 and the information management system 14 as locations for the remote responder device 30 to access client information from. The additional client data includes one or more maps of at least portions of the client site and fire panel information relating to the client site. It will however be appreciated that any other information may form part of the additional client data.

On receipt of the initialisation request, the information management system 14 creates and maintains a respond site record (see block 56). As part of this step, all relevant information is stored in the database of the information management system 14.

The respond site record includes a client identifier received with the initialisation request, and the location information on client data. In the event that the information management system 14 is to be a location of client data, the respond site record is also to include one or more sources of client data. For example, if the client data relates to surveillance camera video content, the sources of client data may include the IP address, connection ports for the surveillance camera and login credentials.

As shown by block 58, the information management system 14 then generates a respond site code which is uniquely to identify the particular respond site record stored in the database of the information management system 14. The respond site code is then transmitted to the central monitoring system 12 (see reference 60).

The information management system 14 is to notify any source of client data of which location information is kept at the information management system 14 that a remote responder device 30 is shortly to establish a connection with such source. These notifications may be in a predetermined communication format which includes the respond site code to positively identify the responder device 30 in due course.

Figure 5:
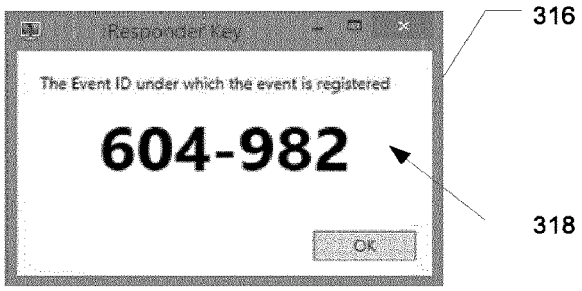
FIG. 5 shows yet another secondary window generated by the central monitoring system of FIG. 1, which window indicates the receipt of a message from the information management system of FIG. 1, in accordance with an example embodiment of the invention.
Figure 6:
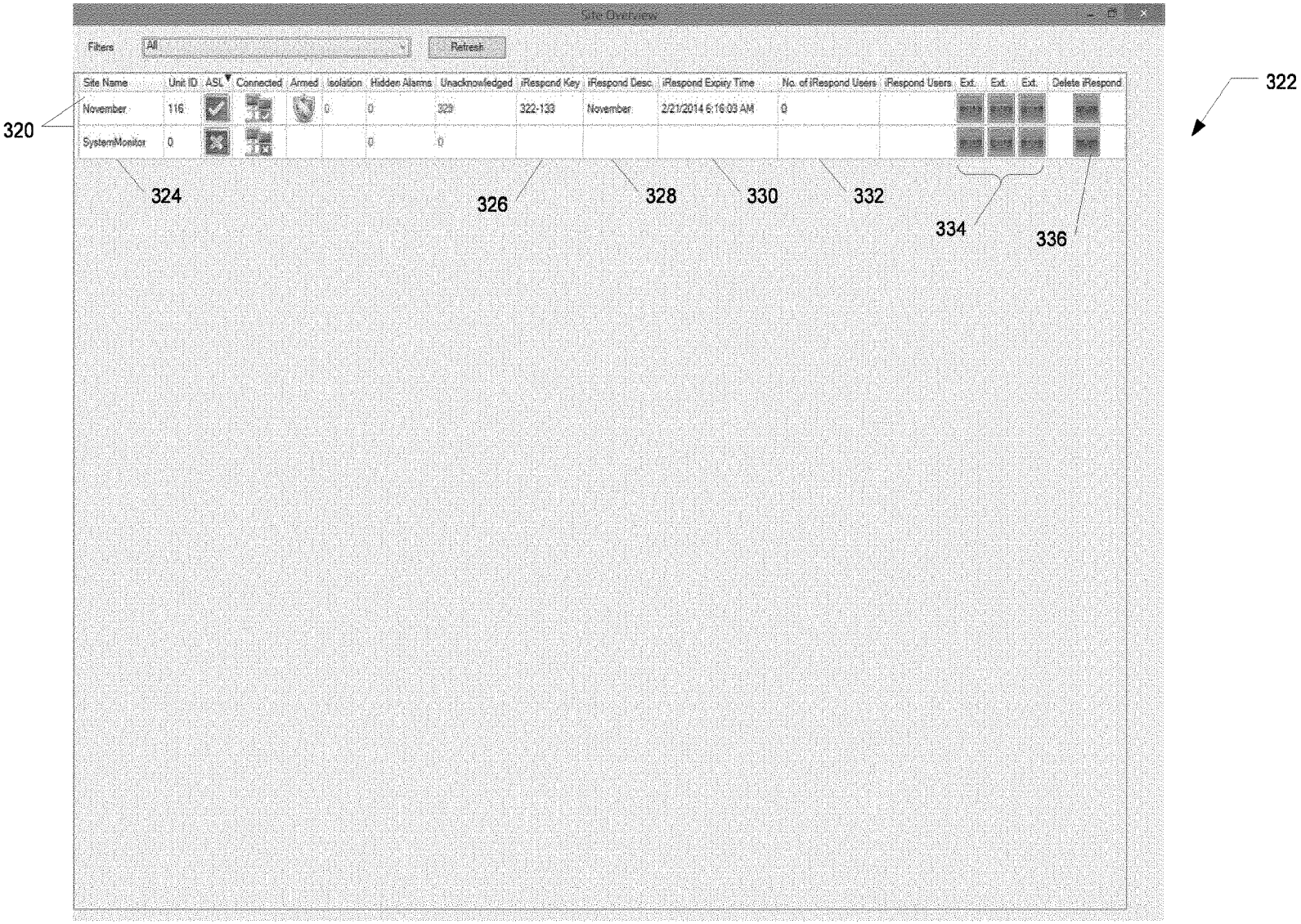
FIG. 6 shows yet a further secondary window generated by the central monitoring system of FIG. 1, which shows active client event records, in accordance with an example embodiment of the invention.

FIG. 5 shows an example embodiment of an interface window 316 of the user interface of the central monitoring system 12, displaying the received respond site code 318. On receipt of the respond site code 318 by the central monitoring system 12, the code 318 is automatically stored in the client event record (see block 62 of FIG. 2*a*). As is shown in FIG. 6, information 320 on active client event records may be displayed on an event record interface page 322 that sets out the site name 324, the client site code 326, the expiration time of the active status of the record 328, the number of responders using the client site code 330 and the responder names 332. The interface page 322 may also include user soft input buttons 334 to allow the operator to extend the active period of a status of the record by the click of a button and a soft button 336 to change the record status to inactive.

Returning to FIG. 2*a*, the operator is now to contact the fire brigade (the third party dispatching service) and advise them of the threat event at the client site. The operator will also provide the fire brigade with the address of the client site and with the client site code (see 64). It will be appreciated that the client site code could be provided to the fire brigade during a second call. In certain scenarios, more than one dispatching service may be contacted, e.g., the police, a security company or the like may also be contacted.

Although the client site code is in this example embodiment to be provided to the dispatching service manually, it is envisaged that the code may also be provided to a dispatching service or system automatically, by means of other communication channels such as email, text messages (SMS) or other suitable messaging applications, or the like.

In one example embodiment of the invention, the location information that is to be available at the information management system 14 is sent to the information management system 14 by the central monitoring system 12 as a separate communication only once the respond site code has been received by the central monitoring system 12.

The client data mentioned in all the paragraphs above may include, but is not limited to:

- a name of the client site;
- one or more maps of at least portions of the client site;
- live video streams from one or more surveillance cameras at the client site;
- contact details of a key-holder to the client site;
- fire panel information relating to the client site; and
- an address of the client site.

Figure 7:
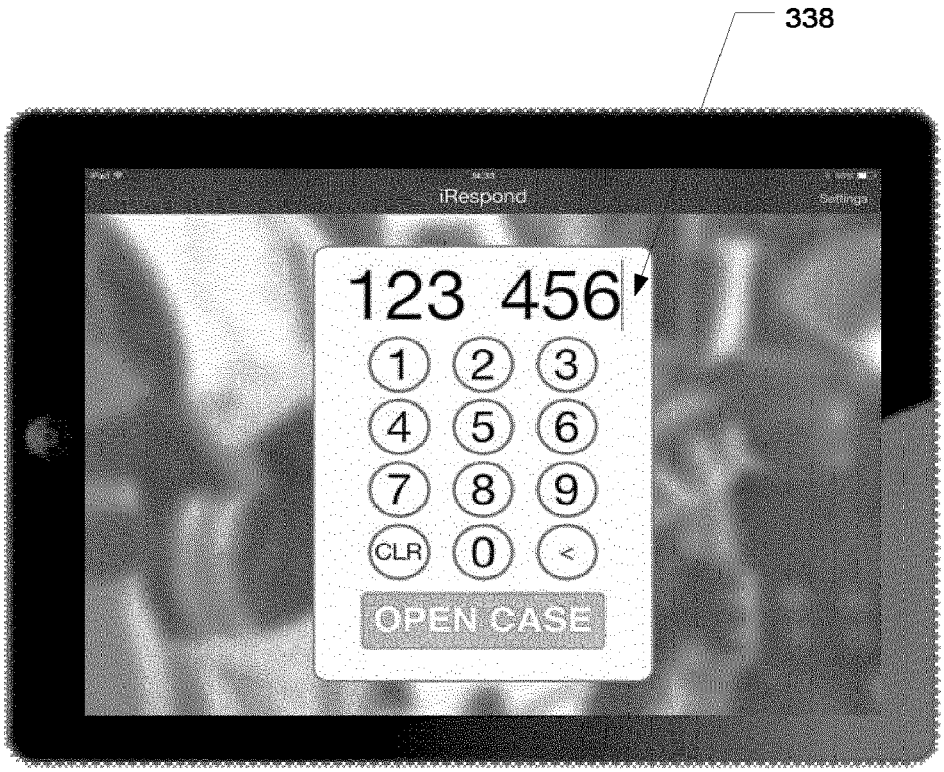
FIG. 7 shows a graphical user interface window generated by a remote responder device of the threat detection information distribution system of FIG. 1, the interface prompting a user to enter information relating to a particular client site, in accordance with an example embodiment of the invention.

On receipt of the respond site code, the fire brigade contacts its fire brigade team that has been or is about to be sent out to the client site 24. The respond site code is provided to this team or an individual (i.e. the responder) representing the team. This responder launches the threat-detection software application on the responder's remote responder device 30 and is prompted to enter the client site number received from its dispatching service. The number is then entered via the graphical user interface 338 generated by the threat-detection software application, as shown by FIG. 7 and block 66 of FIG. 2*a*.

Once the respond site code is entered into the threat-detection software application of the detector device 30, the application automatically transmits the code as part of a verification request to the information management system 14 (see block 68) where the respond site code is verified (block 70) as corresponding to a respond site code in the database of the information management system 14. Together with the verification request (again block 68), the software application transmits a user name of the responder, which username is typically stored by the software application during the setup of the application on the responder device 30.

In the event that the respond site code is verified as existing in the database of the information management system 14, the client data location information associated with the respond site code and stored in the database is looked up (block 72) and transmitted to the software application of the responder device 30 (block 74). The information management system 14 also transmits the username of the responder device to the central monitoring system 12 for later use (block 76) and display on the user interface shown in FIG. 6.

Once the threat-detection mobile application has received the client data location information, the software application uses the location information automatically to obtain client data from the relevant source location or to obtain further information on one or more sources of client data (see block 78). In this particular example, the software application on the responder device 30 obtains from the information management system 14 location information that indicates client data is to be obtained from both the information management system 14 and from the central monitoring system 12. The responder device 30 then obtains from the information management system 14 the IP addresses, connection ports and login credentials for surveillance cameras at the client site 24, whereafter the software application establishes one or more connections with the surveillance cameras to obtain video content (blocks 80).

The responder device 30 also obtains client data from the central monitoring system 12, in this particular embodiment the map information of the client site 24 which is stored at the central monitoring system 12. This step is shown by one of blocks 80 in FIG. 2*b*.

Figure 8:
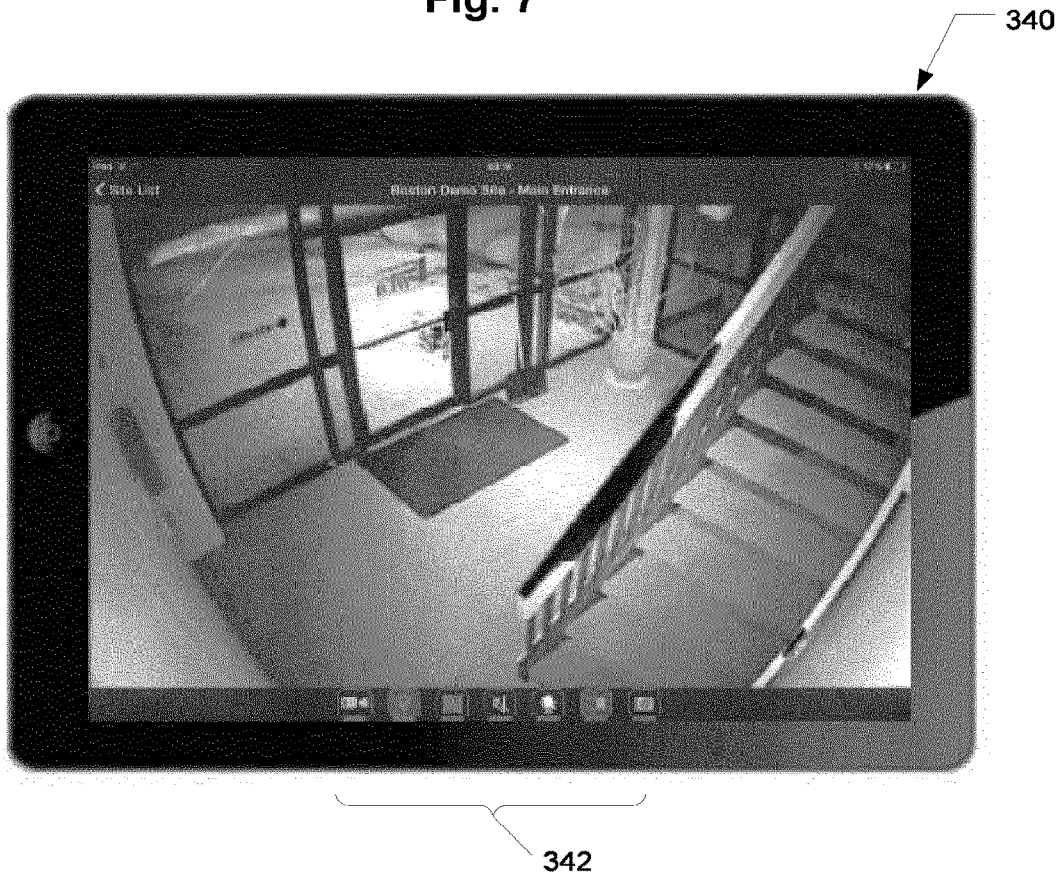
FIG. 8 shows yet another secondary window of the graphical user interface of FIG. 7, which indicates video content displayed on the responder device.

The display of a video feed received by the responder device 30 is shown in FIG. 8. The graphical user interface 340 provided by the theft-detection software application allows the responder to move between different information aspects of the client site through soft buttons 342 at the bottom of the interface 344, whether the information aspects relate to different video feeds, maps or other client information.

In order to ensure secure communications, all client site data, whether location data or otherwise will be encrypted. Any appropriate encryption algorithm may be used.

As already described above, in the present example, in order to further protect client site data, the operator of the central monitoring system 12 is able to restrict access to client data by assigning a status to a client event record stored at the central monitoring system 12, and in turn, to the respond site record stored at the information management system 14.

Typically, and as described above, the status of the records may be assigned an active status for a predetermined amount of time. Whenever the time expires, the status of the client event record will automatically change to inactive at the central monitoring system 12 (see block 82). Updated status information is also continuously communicated to the information management system 14 (block 84) where it is stored (block 86), which in turn, communicates it to the software application module on the remote responder device 30 (block 88). These communications may be through an appropriate push or pull function, such as polling processes. Once the respond site status is turned to inactive, the software application terminates all communications with sources of client data and no further client site information will be available on the responder device 30 (see block 90).

In other scenarios, and as already mentioned in terms of FIG. 6, the operator could alternatively extend the predetermined period or manually terminate the record (block 92), thereby setting the status to inactive. In the case of the predetermined period, the central monitoring system 12 will then provide an inactive status to the information management system 14 only after the expiry of the new time period, while in the case of the termination, the inactive status will be communicated to the information management system 14, and then to the responder device 30, as soon as possible. These features of extending the time periods or deleting the record is very useful as the operator is to continuously monitor developments of the threat event at the client site. For example, if the threat event is resolved, the record will be terminated or deleted, while the time period will be extended if it appears, e.g., that the responders need more time.

Although not described in detail, the central monitoring system 12 may further be adapted to enable the operator to provide additional comments on the threat event at the client site. These comments may be communicated as messages to the information management system 14 for further transmission to the remote responder device 30. Additional technical information could also be sent through by this means to the remote responder device 30. It is also possible for the additional client site information and threat detection information (e.g., further surveillance cameras from which video content is to be monitored) to be provided to the remote responder device 30. Again, this information may be received from the client threat detection system 18 as further threat detection alerts, or may be selected or inputted manually by the operator of the central monitoring system 12. Similar to what has been described above, this information will then be added to the client event record, and updates will be sent to the information management system 14, which in turn is to update the respond site record. The updated information is then to be made available to the remote responder device 30 during the next communication between the information management system 14 and the responder device 30.

The present invention provides simplified means for third party responders to gain insight on client site threat events prior to their arrival on site. The insight gained through the additional and early information occurs without the responder without having to know or enter technical details or search through extensive information. Having the situational awareness information allows the responders to be better prepared for appropriate action and also assist them to take the necessary precautions with relation to their own safety. For example, more information prior to arriving at the client site may additionally assist the first responder and dispatching service to know whether a sufficient response team has been sent to the site, whether the responder carries the correct equipment, what to expect in terms of threat type, site location, site layout. More information may also assist the first responder to take the necessary precautionary safety measures when entering the client site. The saving of time by early assessment of the threat event at the client site, may additionally prevent or further limit damage or business interruption.

Figure 9:
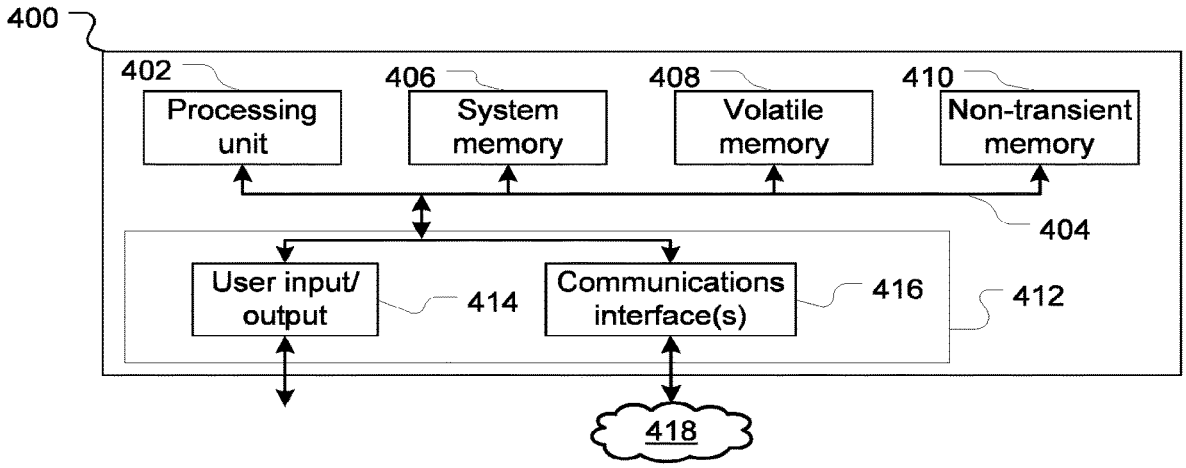
FIG. 9 is a block diagram illustrating a typical computer processing system for use in the threat detection information distribution system, in accordance with an example embodiment.

FIG. 9 is a block diagram illustrating a typical computer processing system 400 suitable for use/configuration as the central monitoring system 12, information management system 14 or client threat-detection system 16, 18 and 20.

Computer processing system 400 comprises a processing unit 402. The processing unit 402 may comprise a single computer-processing device (e.g. a central processing unit, graphics processing unit, or other computational device), or may comprise a plurality of computer processing devices. In some instances processing is performed solely by processing unit 402, however in other instances processing may also, or alternatively, be performed by remote processing devices accessible and useable (either in a shared or dedicated manner) by the computer processing system 400.

Through a communications bus 404 the processing unit 402 is in data communication with one or more machine-readable storage (memory) devices that store instructions and/or data for controlling operation of the computer processing system 400. In this instance computer processing system 400 comprises a system memory 406 (e.g. a BIOS or flash memory), volatile memory 408 (e.g. random access memory such as one or more DRAM modules), and non-volatile/non-transient memory 410 (e.g. one or more hard disk or solid state drives).

Computer processing system 400 also comprises one or more interfaces, indicated generally by 412, via which the computer processing system 400 interfaces with various components, other devices and/or networks. Other components/devices may be physically integrated with the computer processing system 400, or may be physically separate. Where such devices are physically separate connection with the computer processing system 400 may be via wired or wireless hardware and communication protocols, and may be direct or indirect (e.g., networked) connections.

Wired connection with other devices/networks may be by any standard or proprietary hardware and connectivity protocols. For example, the computer processing system 400 may be configured for wired connection with other devices/ communications networks by one or more of: USB; FireWire; eSATA; Thunderbolt; Ethernet; Parallel; Serial; HDMI; DVI; VGA; AudioPort. Other wired connections are possible.

Wireless connection with other devices/networks may similarly be by any standard or proprietary hardware and communications protocols. For example, the computer processing system 400 may be configured for wireless connection with other devices/communications networks using one or more of: infrared; Bluetooth (including early versions of Bluetooth, Bluetooth 4.0/4.1/4.2 (also known as Bluetooth low energy) and future Bluetooth versions); Wi-Fi; near field communications (NFC); Global System for Mobile Communications (GSM), Enhanced Data GSM Environment (EDGE), long term evolution (LTE), wideband code division multiple access (W-CDMA), code division multiple access (CDMA). Other wireless connections are possible.

Generally speaking, the devices to which computer processing system 400 connects—whether by wired or wireless means—allow data to be input into/received by computer processing system 400 for processing by the processing unit 402, and data to be output by computer processing system 400. Example devices are described below, however it will be appreciated that not all computer processing systems will comprise all mentioned devices, and that additional and alternative devices to those mentioned may well be used.

For example, computer processing system 400 may comprise or connect to one or more input devices by which information/data is input into (received by) the computer processing system 400. Such input devices may comprise physical buttons, alphanumeric input devices (e.g., keyboards), pointing devices (e.g., mice, track-pads and the like), touchscreens, touchscreen displays, microphones, accelerometers, proximity sensors, GPS devices and the like. Computer processing system 400 may also comprise or connect to one or more output devices controlled by computer processing system 400 to output information. Such output devices may comprise devices such as indicators (e.g., LED, LCD or other lights), displays (e.g., LCD displays, LED displays, plasma displays, touch screen displays), audio output devices such as speakers, vibration modules, and other output devices. Computer processing system 400 may also comprise or connect to devices capable of being both input and output devices, for example memory devices (hard drives, solid state drives, disk drives, compact flash cards, SD cards and the like) which computer processing system 400 can read data from and/or write data to, and touch-screen displays which can both display (output) data and receive touch signals (input).

Computer processing system 400 may also connect to communications networks (e.g. the Internet, a local area network, a wide area network, a personal hotspot etc.) to communicate data to and receive data from networked devices, which may be other computer processing systems.

The architecture depicted in FIG. 9 may be implemented in a variety of computer processing systems, for example a laptop computer, a netbook computer, a tablet computer, a smart phone, a desktop computer, a server computer. It will also be appreciated that FIG. 9 does not illustrate all functional or physical components of a computer processing system. For example, no power supply or power supply interface has been depicted, however computer processing system 400 will carry a power supply (e.g. a battery) and/or be connectable to a power supply. It will further be appreciated that the particular type of computer processing system will determine the appropriate hardware and architecture, and alternative computer processing systems may have additional, alternative, or fewer components than those depicted, combine two or more components, and/or have a different configuration or arrangement of components.

Operation of the computer processing system 400 is also caused by one or more computer program modules which configure computer processing system 400 to receive, process, and output data.

As used herein, the term "module" to refers to computer program instruction and other logic for providing a specified functionality. A module can be implemented in hardware, firmware, and/or software. A module is typically stored on the storage device 408, loaded into the memory 406, and executed by the processor 402.

A module can include one or more processes, and/or be provided by only part of a process. Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

It will be appreciated that the types of computer systems 400 used by the respective entities of FIG. 1 may vary depending upon the embodiment and the processing power used by the entity. For example, the server systems may comprise multiple blade servers working together to provide the functionality described herein.

The invention claimed is:

1. A method of obtaining client data at a responder device, the client data relating to a client site monitored by threat-detection system, the method including:

at the responder device, receiving a respond site code associated with a respond site record stored at a threat-detection information management system;

transmitting the respond site code to the threat-detection information management system in order for the system to verify the existence of the respond site record on a data storage at the information management system;

receiving a response from the information management system providing client data location information, which location information specifies one or more sources of client data relevant to a particular threat that has been detected at a client site associated with the respond site record;

in response to receiving the client data location information, establishing a connection with the one or more sources in order for the responder device to receive client data relevant to the particular threat; and displaying at least some of the received client data on a display of the responder device.

2. The method as claimed in claim 1 wherein the received client data includes one or more of the following:

a name of the client site;

one or more maps of at least portions of the client site;

video content from one or more surveillance cameras at the client site;

contact details of a key-holder to the client site;

fire panel information relating to the client site; and an address of the client site.

3. The method as claimed in claim 1 wherein the step of establishing a connection with the one or more sources includes parsing the client data location information in order to obtain one or more network location addresses, associated connection port data and login credentials; establishing one or more communication channels based on the parsed information; and receiving client data relevant to a particular threat that has been detected by the threat-detection system.

4. The method as claimed in claim 1 wherein the response from the information management system further includes a status associated with the respond site record which status, when active, allows the responder device access to the one or more sources of the client data, when temporarily active, allows the responder device access until the expiration of a predetermined time period, and when inactive, disallows access to the one or more sources of the client data.

5. The method as claimed in claim 4 wherein the step of establishing a connection with the one or more sources includes parsing the client data location information in order to obtain one or more network location addresses, associated connection port data and login credentials; establishing one or more communication channels based on the parsed information; and receiving client data relevant to a particular threat that has been detected by the threat-detection system.

6. The method as claimed in claim 4 wherein the received client data includes one or more of the following:

a name of the client site;

one or more maps of at least portions of the client site;

video content from one or more surveillance cameras at the client site;

contact details of a key-holder to the client site;

fire panel information relating to the client site; and an address of the client site.

7. The method as claimed in claim 4 further including:

receiving an updated respond site record status at the responder device, in response to which the status is changed to inactive, thereby disallowing the responder device to obtain client data;

or wherein the predetermined period of the temporarily active status is extended for a further period.

8. The method as claimed in claim 7 wherein the step of establishing a connection with the one or more sources includes parsing the client data location information in order to obtain one or more network location addresses, associated connection port data and login credentials; establishing one or more communication channels based on the parsed information; and receiving client data relevant to a particular threat that has been detected by the threat-detection system.

9. The method as claimed in claim 7 wherein the received client data includes one or more of the following:

a name of the client site;

one or more maps of at least portions of the client site;

video content from one or more surveillance cameras at the client site;

contact details of a key-holder to the client site;

fire panel information relating to the client site; and an address of the client site.

10. The method as claimed in claim 7 wherein the step of receiving the updated client record status is preceded by polling the information management system.

11. The method as claimed in claim 10 wherein the step of establishing a connection with the one or more sources includes parsing the client data location information in order to obtain one or more network location addresses, associated connection port data and login credentials; establishing one or more communication channels based on the parsed information; and receiving client data relevant to a particular threat that has been detected by the threat-detection system.

12. The method as claimed in claim 10 wherein the received client data includes one or more of the following:

a name of the client site;

one or more maps of at least portions of the client site;

video content from one or more surveillance cameras at the client site;

contact details of a key-holder to the client site;

fire panel information relating to the client site; and an address of the client site.

13. The method as claimed in claim 1 further including receiving an operator message relevant to the monitored client site.

14. A method of obtaining client data at a responder device, the client data relating to a client site monitored by threat-detection system, the method including:

at the responder device, receiving a respond site code associated with a respond site record stored at a threat-detection information management system;

transmitting the respond site code to the threat-detection information management system in order for the system to verify the existence of the respond site record on a data storage at the information management system;

receiving a response from the information management system providing client data location information, which location information specifies one or more sources of client data relevant to a particular threat that has been detected at a client site associated with the respond site record;

in response to receiving the client data location information, establishing a connection with the one or more sources in order for the responder device to receive client data relevant to the particular threat;

displaying at least some of the received client data on a display of the responder device;

generating and launching a graphical user interface prompting a user to enter the respond site code; and wherein the respond site code is received as a user input through the graphical user interface displayed on the responder device.

15. The method as claimed in claim 14 further including:

receiving an updated respond site record status at the responder device, in response to which the status is changed to inactive, thereby disallowing the responder device to obtain client data; or wherein the predetermined period of the temporarily active status is extended for a further period.

16. The method as claimed in claim 15 wherein the step of receiving the updated client record status is preceded by polling the information management system.

17. The method as claimed in claim 14 wherein the step of establishing a connection with the one or more sources includes parsing the client data location information in order to obtain one or more network location addresses, associated connection port data and login credentials; establishing one or more communication channels based on the parsed information; and receiving client data relevant to a particular threat that has been detected by the threat-detection system.

18. The method as claimed in claim 14 wherein the received client data includes one or more of the following:

a name of the client site;

one or more maps of at least portions of the client site;

video content from one or more surveillance cameras at the client site;

contact details of a key-holder to the client site;

fire panel information relating to the client site; and an address of the client site.

19. The method as claimed claim 14 further including receiving an operator message relevant to the monitored client site.

20. A computer program product for execution on a portable communication device comprising a user input and display, the computer program product comprising a non-transitory computer readable medium having computer readable and executable code for instructing one or more processors to perform a method, the method comprising:

receive, at the communication device a respond site code associated with a respond site record stored at a threat-detection information management system;

transmit the respond site code to the threat-detection information management system in order for the system to verify the existence of the respond site record on a data storage at the information management system;

receive a response from the information management system providing client data location information, which location information specifies one or more sources of client data relevant to a particular threat that has been detected at a client site associated with the respond site record;

in response to the receipt of the client data location information, establish a connection with the one or more sources in order for the communication device to receive client data relevant to the particular threat; and display at least some of the received client data on a display of the communication device.

* * * * *